United States Patent [19]

Baker et al.

[11] Patent Number: 4,914,885

[45] Date of Patent: Apr. 10, 1990

[54] ROOFING TILE

[75] Inventors: Philip S. Baker, Coral Springs; Steven T. Collette, Del Ray Beach, both of Fla.

[73] Assignee: Gory Associated Industries, Inc., Pompano Beach, Fla.

[21] Appl. No.: 237,958

[22] Filed: Aug. 29, 1988

[51] Int. Cl.[4] ..... E04D 1/00

[52] U.S. Cl. ..... 52/520; 52/533; 52/541; 52/542; 52/547; 52/549

[58] Field of Search ..... 52/533, 535, 536, 538, 52/539, 520, 518, 541, 542, 547, 549

[56] References Cited

U.S. PATENT DOCUMENTS

| | | | |
|---|---|---|---|
| D. 281,536 | 11/1985 | O'Donnell . | |
| D. 282,288 | 1/1986 | Bates . | |
| 491,625 | 2/1893 | Wutke . | |
| 557,137 | 3/1896 | Merrill . | |
| 579,481 | 3/1897 | Harris . | |
| 592,474 | 10/1897 | Merrill . | |
| 892,917 | 7/1908 | Walker . | |
| 1,030,590 | 6/1912 | Latulip . | |
| 1,226,888 | 5/1917 | Hughes et al. . | |
| 1,427,968 | 9/1922 | Pedersen . | |
| 1,590,744 | 6/1926 | Hatch | 52/520 |
| 1,999,244 | 4/1935 | Ludowici | 52/533 |
| 2,210,941 | 8/1940 | Leemhuis . | |
| 2,510,416 | 6/1950 | Pretty . | |
| 3,412,517 | 11/1968 | Ellis et al. . | |
| 3,544,416 | 12/1970 | Gebhard, Jr. . | |
| 3,579,940 | 5/1971 | Greenleaf . | |
| 3,771,271 | 11/1973 | Keel . | |
| 3,783,570 | 1/1974 | Storch . | |
| 3,862,532 | 1/1975 | Markos . | |
| 3,897,667 | 8/1975 | Turek . | |
| 4,120,132 | 10/1978 | Kendrick . | |
| 4,189,889 | 2/1980 | Yanoh . | |
| 4,262,466 | 4/1981 | Roe . | |
| 4,372,090 | 2/1983 | Shichijo . | |
| 4,432,183 | 2/1984 | Pike et al. | 52/533 |
| 4,446,665 | 5/1984 | Berger . | |
| 4,574,536 | 3/1986 | Bamber et al. | 52/533 |
| 4,578,917 | 4/1986 | Probst . | |
| 4,603,529 | 8/1986 | Cronenwett et al. . | |
| 4,606,164 | 8/1986 | Mendez . | |
| 4,622,789 | 11/1986 | Quinnell . | |
| 4,662,141 | 5/1987 | Miko . | |

*Primary Examiner*—David A. Scherbel
*Assistant Examiner*—Michele A. Van Patten
*Attorney, Agent, or Firm*—Brumbaugh, Graves, Donohue & Raymond

[57] ABSTRACT

An improved roofing tile with side flanges, one overlying and one underlying, providing an interlock between adjacent tiles. The flanges have two ridges and two grooves each. The inner ridge of the underlying flange is higher than the outer ridge thereof, and the outer groove of the overlying flange is deeper than the inner groove thereof. Optionally a cutout is provided on the overlying flange permitting a tile to be held with a hurricane clip on the underlying flange. Optionally a cavity is provided on the bottom face toward the lower edge to prevent a tile coming in contact with nails driven through tiles in a lower course.

4 Claims, 6 Drawing Sheets

ROOFING TILE

BACKGROUND OF THE INVENTION

This invention relates to an improvement in roofing tile, and more particularly to a flat shingle style roofing tile having improved ease of packaging, improved versatility in choice of installation methods, and improved roof life span.

With some previous roofing tile designs, the tile is mounted to the underlayment by mechanical fasteners such as copper or galvanized nails driven through nailholes. With other roofing tile designs, the tile is mounted to the underlayment by means of a mortar mix used as an adhesive. Still other designs require that battens, that is, long thin transverse wood strips, be installed on the underlayment, and the tiles are then hung on the battens, and optionally the tiles are secured to the battens by mechanical fasteners such as copper or galvanized nails driven through nailholes.

After a course of tiles has been installed and secured by mechanical fasteners such as copper or galvanized nails driven through nailholes, generally another course of tiles is installed higher on the roof, with a region of overlap of typically 2 to 3 inches, in which a lower portion of the upper tile course lies on top of an upper portion of the lower tile course. The overlap allows the upper tile course to protect the nails and nailholes of the lower tile course, thus minimizing leakage of water to the underlayment, and minimizing corrosion of the nails.

Because of the overlap, tiles of prior designs have sometimes given rise to a completed installation in which the upper tiles rest in part on the nails, making an uneven roof as the nails are not of uniform height and the tiles thus cannot lie correctly.

In addition to the stability provided by laying the tile onto battens, or by the use of mechanical fasteners driven through nailholes, some installations require the use of so-called "hurricane clips" . These clips are mechanical fasteners which hook over a tile at a location lower on the roof than the nailholes, typically at a lower point on the left or right edge of the tile. The use of hurricane clips may be indicated by a steep roof pitch, by prevalent high winds, or by building code requirements.

Roofing tiles are not made on site; they must be shipped from the tile factory to the building construction site. Thus it is desirable that the tiles have a shape that permits stacking and shipment on pallets or in wrapped stacks. Some tile designs do not stack neatly, not being substantially flat, and give rise to a shipping load that is unstable and difficult to handle.

With a tile roof it is desirable to minimize leakage of water past the tiles to the underlayment. In prior tile designs, such as that of U.S. Pat. No. 4,432,183, flanges are provided along the left and right edges of the tile. To one side of the tile, the "underlock" side, a groove and ridge are formed during manufacture, with the groove lying between the ridge and the balance of the tile. The groove acts as a water channel, providing a path for the flow of water down the tiles and off the roof. To the other side of the tile, the "overlock" side, an overhanging shape is provided which, when viewed from below, is seen to be a groove and ridge with shape chosen to fit neatly into the groove and ridge on the underlock side of an adjacent tile. Experience shows, however, that the groove and ridge area at the edge of the tile is traditionally the weakest part of the tile.

During installation it is preferable if the installers are able to walk on the parts of the roof, including any areas that have already been covered with tile. It is also preferable that the tile be capable of sustaining loads due to walking after the roof has been completely installed. Building code standards also impose requirements of resistance of breakage, e.g. in the event of breakage of a beam of the underlayment. In tiles of prior designs, moreover, the hurricane clip interferes with the groove and ridge of the overlock and underlock edges of the tile. If the overlock edge of a tile is in contact with the hurricane clip, then pressures due to walking on that tile may break it.

Most prior tile designs for batten installation have a batten support beam on the underside formed so as to engage the batten and to keep the tile from sliding down the roof. Such tile designs, however, generally cannot be used for non-batten nail-on installations because the batten support beam typically makes the top edge of the tile thicker than the bottom, resulting in a tile that cannot lie flat. Furthermore, such tile designs similarly cannot generally be used for mortar installations for the same reason.

The batten support beam in most prior batten-type tile designs renders the tile unusable for direct-deck installations for a second reason. The batten support beam, if in direct contact with the underlayment, gives rise to damming, resulting in water accumulation on the underlayment. Furthermore, the water passing on either side of the batten support beam may reach locations where nails have pierced the underlayment.

Most prior tile designs for nail-on mortar installations cannot generally be used for batten-type installations because the beam which would engage with the batten is missing.

It is an object of the invention to provide a flat shingle style concrete roofing tile. It is a further object of the invention to provide a tile of standard size, shaped so as to lay flat for easier packaging, and so as to permit installation using any of a number of installation means.

SUMMARY OF THE INVENTION

These and other objects of the invention as will become apparent, are accomplished by providing a flat concrete roofing tile with features described herein.

The tile of the invention is substantially rectangular, with a "top" surface facing skyward when installed; a "bottom" surface facing the underlayment; an "upper" edge disposed toward the roof peak; a "lower" edge opposite the upper edge, said lower edge disposed away from the roof peak; and left and right edges. One of the left and right edges is shaped to form an overlock flange, while the other is shaped to form an underlock flange. The flanges differ from flanges in prior tile designs, in that each flange comprises two ridges and two grooves. As in prior designs, the flanges assist in aligning adjacent tiles, and promote drainage of water along the flange rather than to the underlayment. The outside groove on the overlock side is deeper than the inside groove.

In prior tile designs employing interlocking flanges with two grooves and two ridges, e.g. U.S. Pat. No. 491,625 to Wutke, and U.S. Pat No. 1,427,968 to Pedersen, the ridges are typically of the same height, and the grooves are typically of the same depth.

The invention also allows use of hurricane clips which, in prior tiles, would have interfered with the proper mating of the underlock and overlock edges. In the invention, near the lower end of the overlock edge of the tile, a cutout section has been provided at the inside groove and inside ridge. As a result, a tile may be secured by the hurricane clip, which grips the tile on the outer ridge of the underlock edge, and a second tile may be laid to cover the underlock edge, and yet the second tile need not come in direct contact with the hurricane clip, because of the cutout in the overlock area of the second tile.

The underside or bottom of the tile is designed to meet several requirements. The top and bottom edges are the same thickness, which allows the tile to lay flat, course over course, in non-batten installations. The top edge incorporates a batten support beam to engage a batten as described above. Optionally, two batten rests are provided below the batten support beam, so as to promote stability of the tile as it rests on the batten. Without the provision of the two batten rests, variations in tile construction and batten shape could give an individual tile that would tend to rock or wobble on the batten. As mentioned above, a lower edge is provided having the same thickness as the top edge, so that in a batten installation the tile may lie flat upon the next lower course of tile. The batten beam is shaped with a taper, typically 5 degrees, so that if the tile is used in a non-batten installation, the contact between tile and underlayment is not merely along a line but rather over an area of some width.

In the tile of the invention, the batten support beam has a weep hole. The weep hole permits water to drain off the underlayment to the area of the tile below, which is also equipped with a weep hole, and so on until the water has drained from the eaves. The path followed by the water avoids nail holes. The weep holes also promote air circulation, which tends to keep the underlayment dry. This permits a single tile design to be used for both batten and non-batten installations.

On the bottom surface, just above the lower edge, a cavity is provided so that the tile will not rest on nailheads from the tile course below, but will rest on the tile course itself.

The tile of the invention may be secured by mortar or by nails, and may be installed with or without battens.

DETAILED DESCRIPTION OF THE INVENTION

Figure 2:
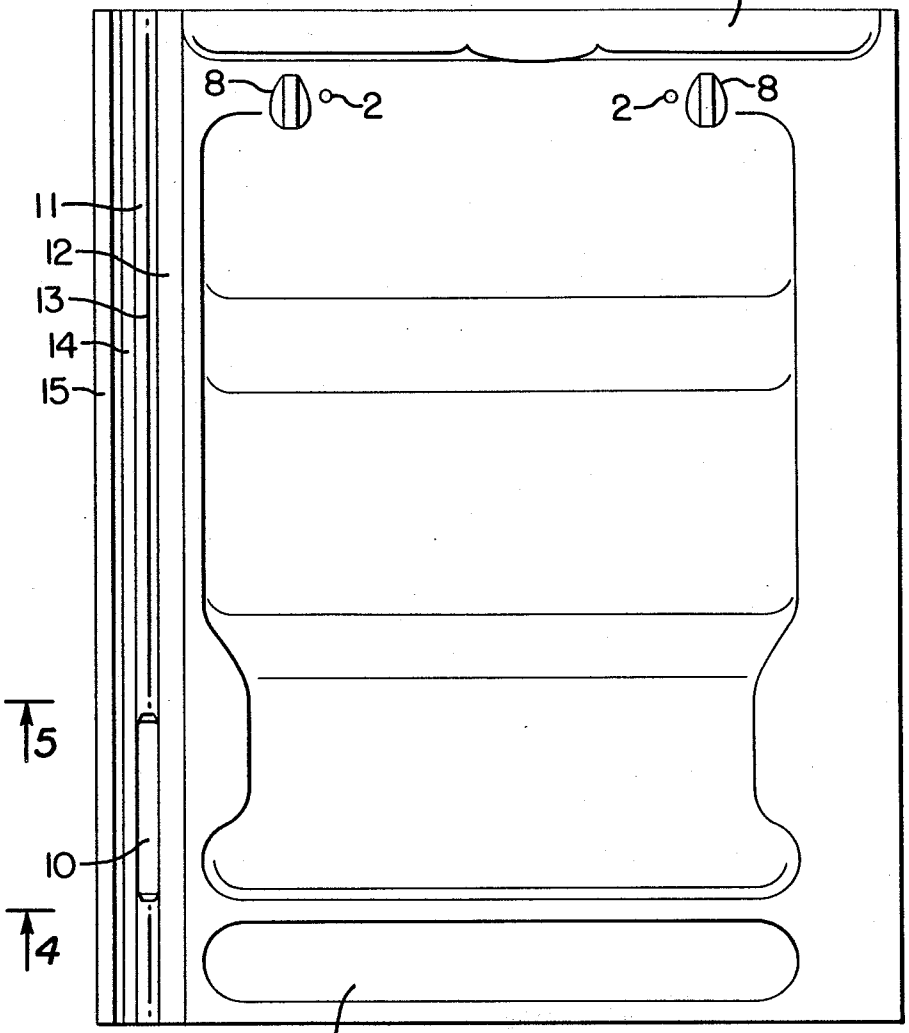
FIG. 2 is an view of the bottom surface of the tile.
Figure 1:
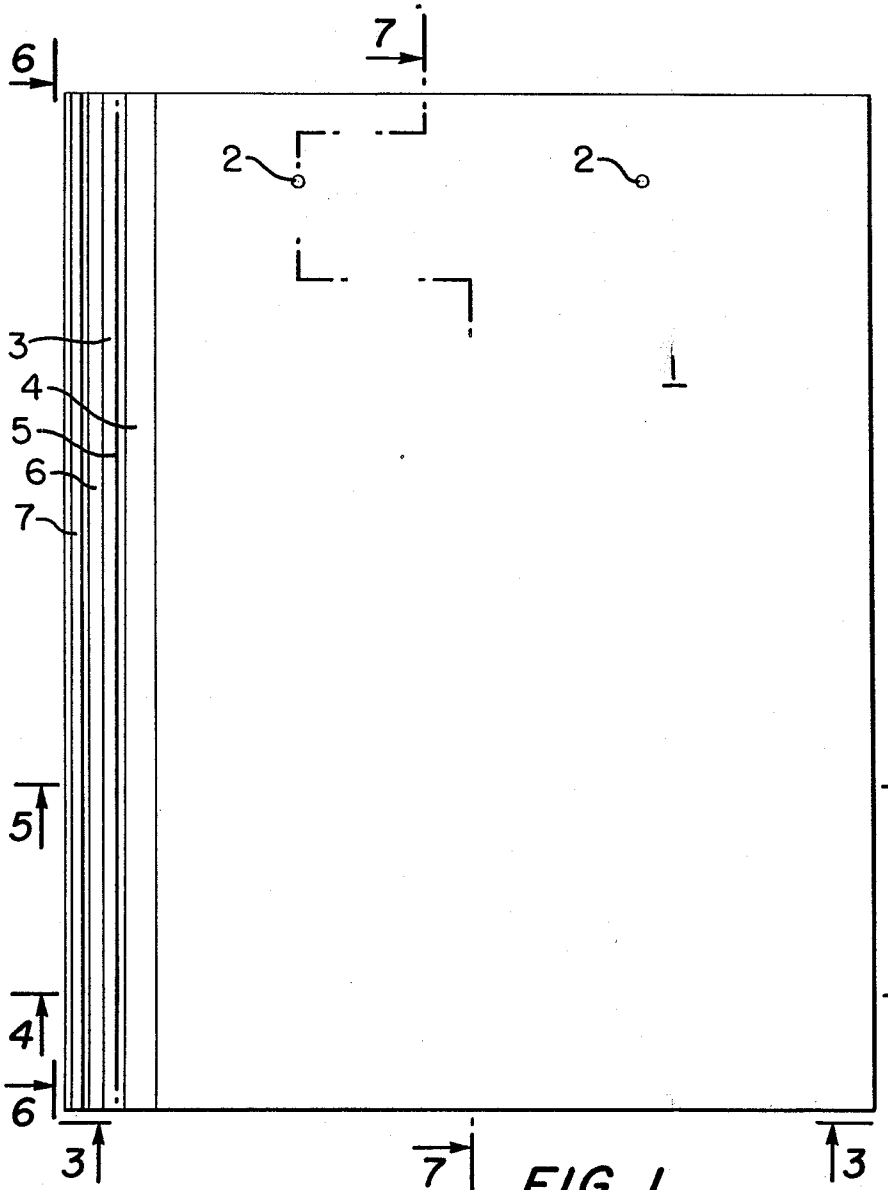
FIG. 1 is a view of the top surface of the tile.
Figure 3:
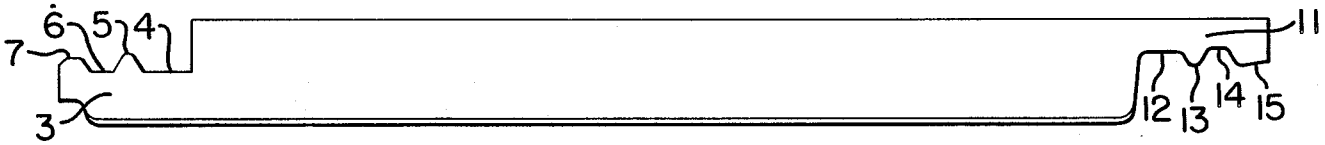
FIG. 3 is an end view of the tile on the line 3—3 of FIG. 1.

As shown in FIG. 1 with reference to FIG. 3, there is provided in accordance with the invention a flat, shingle style concrete roofing tile 1 adapted to be laid over a roofing underlayment in a series of courses. On the top or skyward surface of the tile, shown in FIG. 1, are nailholes 2 and underlap flange 3. Underlap flange 3 is composed of inner groove 4, inner ridge 5, outer groove 6, and outer ridge 7. Inner ridge 5 is higher and thicker than outer ridge 7. FIG. 2 shows the bottom surface of the tile, which faces the underlayment when installation is complete. Nailholes 2 may be seen as in FIG. 1, flanked by batten rests 8. Above nailholes 2 is batten support beam 17 extending nearly from one side edge to the other edge. Cavity 9 is provided to prevent the tile from coming in contact with any nailheads in the tile course below. To the left side in the illustration is the overlock flange 11, composed of inner groove 12, inner ridge 13, outer groove 14, and outer ridge 15. Near the lower edge of the tile, inner groove 12 and inner ridge 13 are cut out to form cutout section 10, which is provided to permit installation of a hurricane clip on an adjacent tile.

FIG. 3 is an end view of the tile on the line 3—3 of FIG. 1, showing underlock flange 3, inner and outer grooves 4 and 6, respectively, and inner and outer ridges 5 and 7, respectively. It may be seen that ridge 5 is higher and thicker than ridge 7. Overlock flange 11 is shown, with inner groove 12, inner ridge 13, outer groove 14, and outer ridge 15. It may be seen that outer groove 14 is deeper than inner groove 12.

Figure 4:
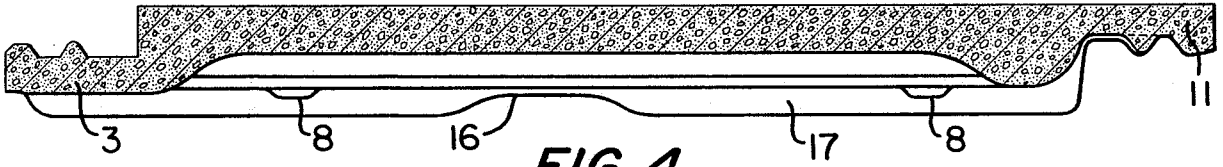
FIG. 4 is a cross-sectional view of the tile on the line 4—4 of FIG. 1.

FIG. 4 shows a cross-section of the tile along the lines 4—4 of FIG. 1. In addition to the underlock and overlock flanges 3 and 11, respectively, the batten rests 8 and batten support beam 17 are shown. Weep hole 16 is provided to allow runoff of any water that may accumulate between the batten support beam 17 and the underlayment.

Figure 5:
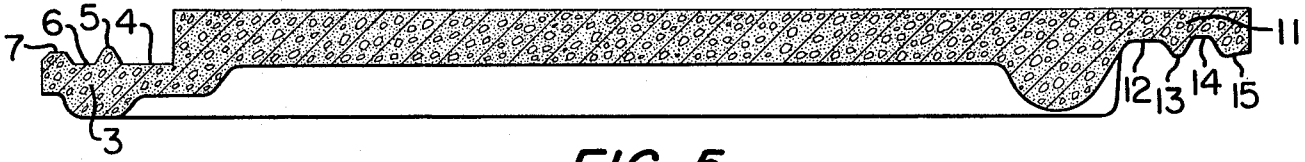
FIG. 5 is a cross-sectional view of the tile on the line 5—5 of FIG. 1.

FIG. 5 is a cross-section of the tile along the lines 5—5 of FIG. 1, showing underlock and overlock flanges 3 and 11, respectively.

Figure 6:
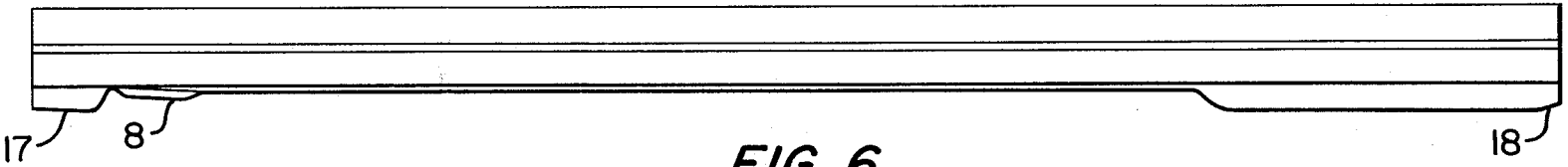
FIG. 6 is a side view of the tile on the line 6—6 of FIG. 1.

FIG. 6 is a side view of the tile along the lines 6—6 of FIG. 1, showing batten support beam 17, batten rest 8, and bottom edge 18; bottom edge 18 is of substantially the same thickness as the top edge including batten support beam 17.

Figure 7:
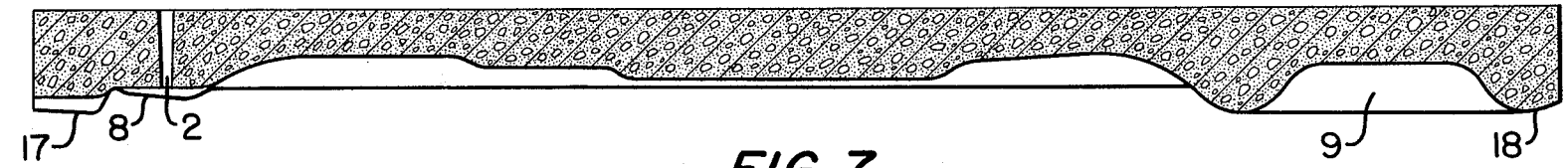
FIG. 7 is a cross-sectional view of the tile on the line 7—7 of FIG. 1.

FIG. 7 is a cross-section of the tile along the lines 7—7 of FIG. 1, showing batten support beam 17, batten rest 8, nailhole 2, bottom edge 18, and cavity 9.

Figure 8:
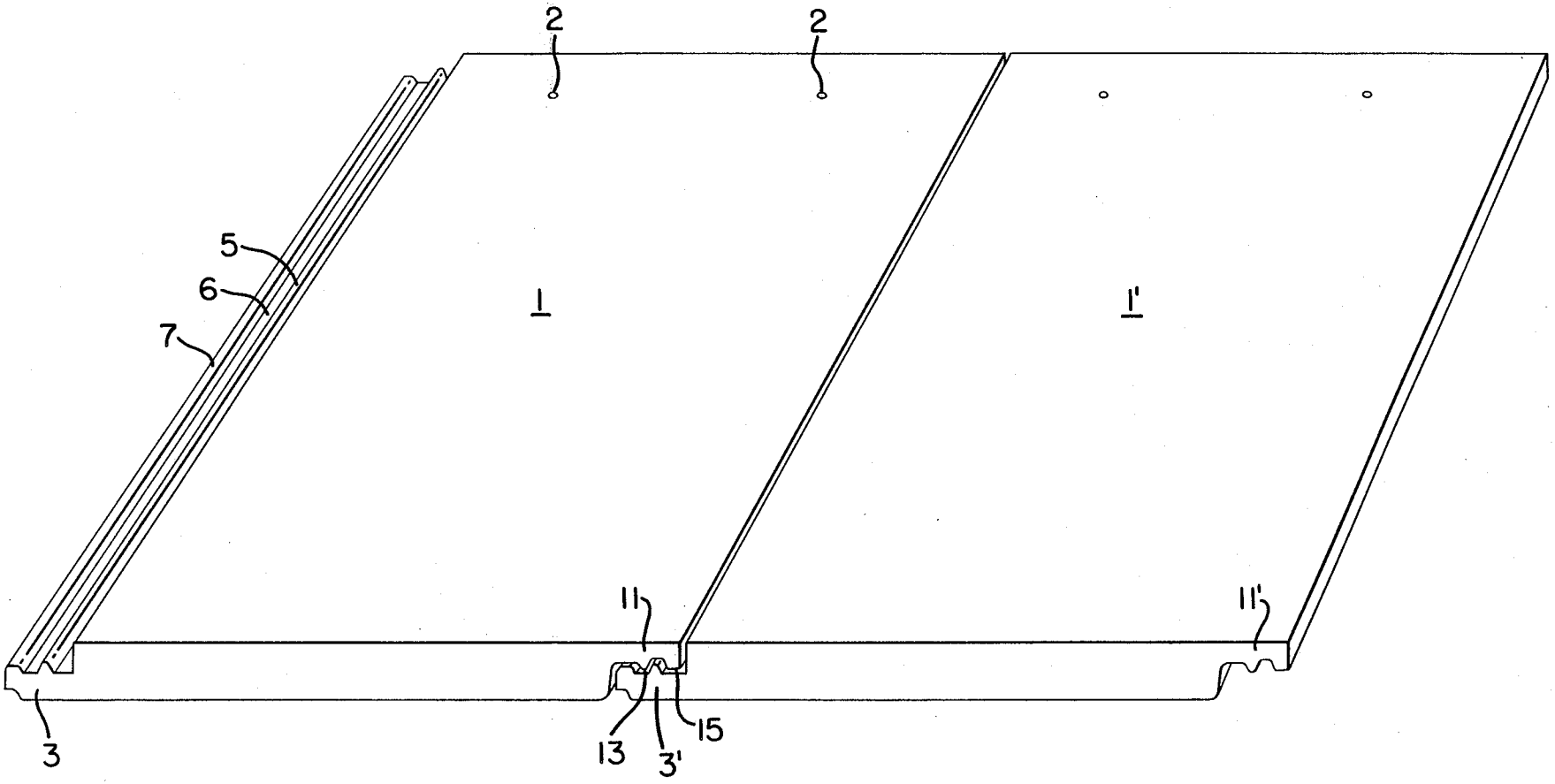
FIG. 8 is a perspective view of the tiles in a transverse course, showing the manner in which the flanges interlock.

FIG. 8 is a perspective view of two tiles 1 and 1' in a transverse course, showing the manner in which underlock flange 3' of tile 1' interlocks with overlock flange 11 of tile 1.

Figure 9:
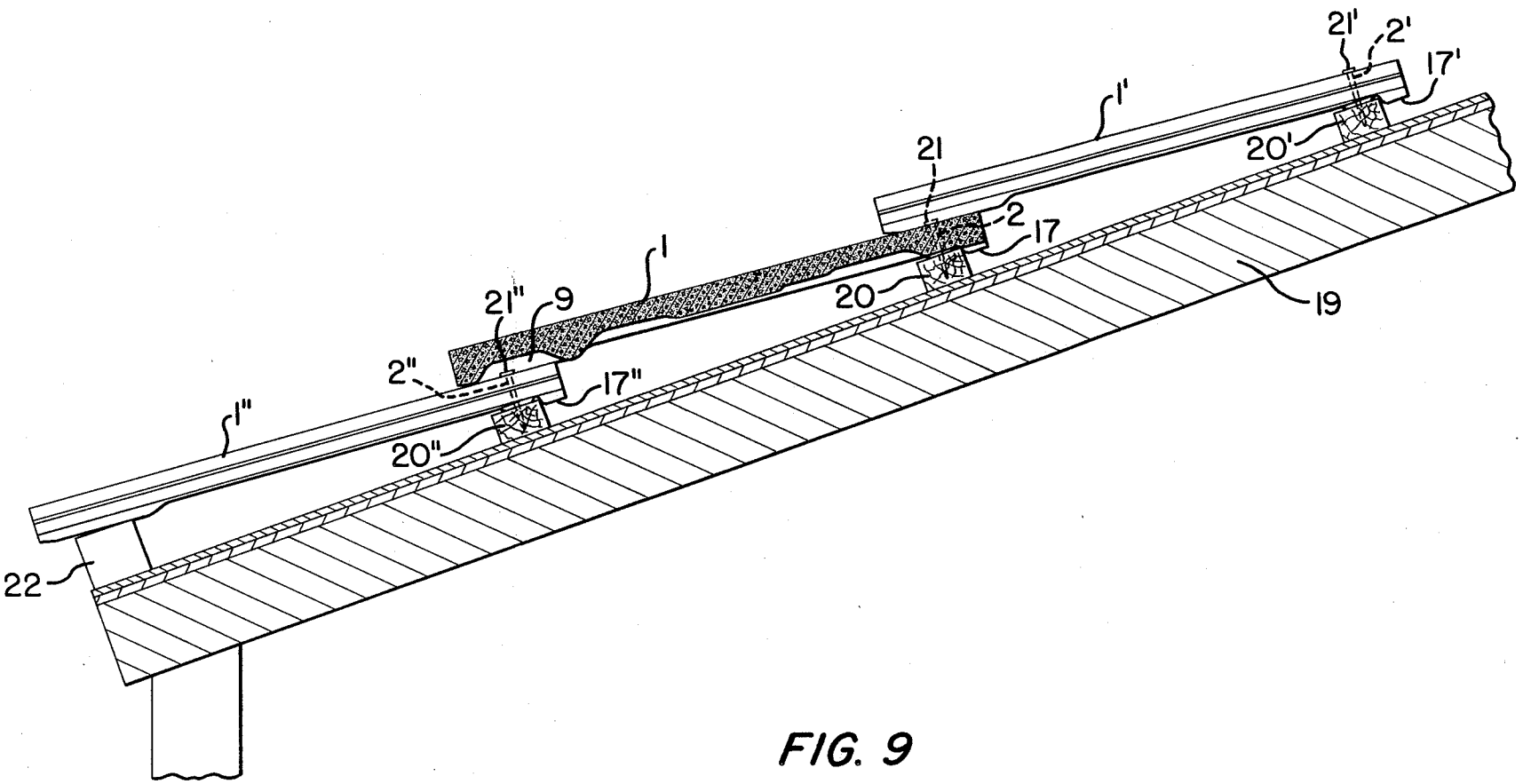
FIG. 9 is a side cross-sectional view of part of a roof using the batten system of installation.

FIG. 9 shows a side cross-sectional view of a part of a roof using the batten system of installation. The well-known underlayment 19 is shown composed of roof deck materials covered with a weather resistant covering. Battens 20, 20' and 20'' and a 2-inch by 2-inch fascia support 22 are mechanically fastened to the roof by well-known methods. Tile 1'' was laid first, followed by tile 1 which was in turn followed by tile 1'. In this embodiment of the invention, each course of tile is offset from the course below, so that while the edges of tiles 1'' and 1' are shown, tile 1 appears in cross section as indicated by the shading. Each tile rests on a batten, said tile held from slipping down the roof by one of batten support beams 17, 17', and 17''', and is further secured by one of nails 21, 21', and 21'' passing through nailholes 2, 2', and 2''. Cavity 9 prevents tile 1 from coming in contact with nail 21''. Because the lower edge is the same thickness as the upper edge, the tile lies flat.

Figure 10:
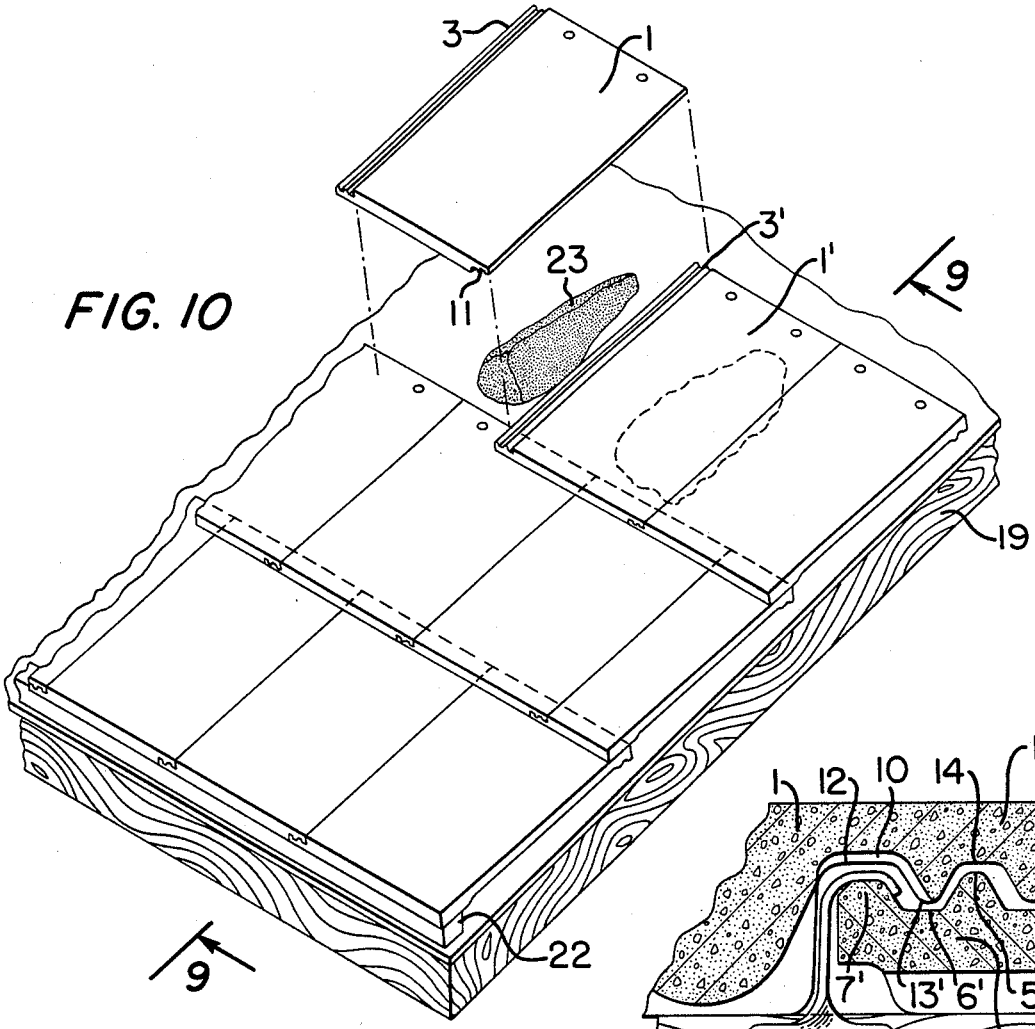
FIG. 10 is a perspective view of part of a roof using the mortar system of installation.

As may be seen from FIG. 10, the tile of the invention may be used in a mortar-style installation. The well-known underlayment 19 is shown composed of roof deck materials covered with a weather resistant covering. Optional battens 20 and 2-inch by 2-inch fascia support 22 are mechanically fastened to the roof by well-known methods. Prior to laying a particular tile 1, mortar 23 is troweled on the underlayment. Tile 1 is pressed into place to allow mortar to adhere to the underside of the tile. Because the lower edge is the same thickness as the upper edge, the tile lies flat.

Figure 11:
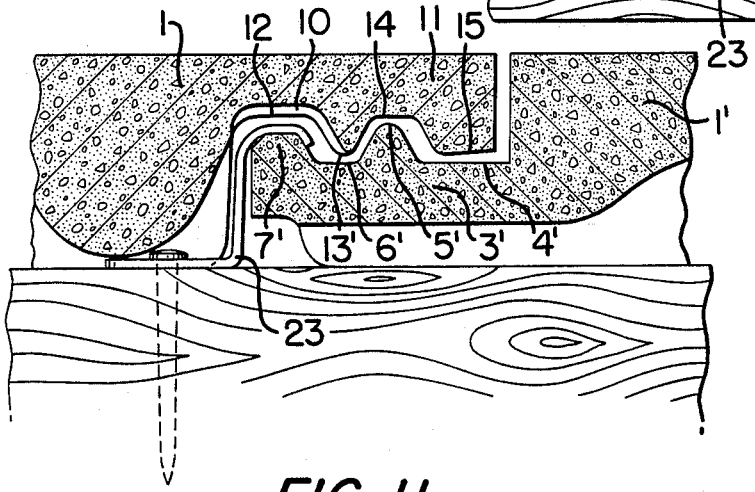
FIG. 11 is a transverse cross-sectional view of a portion of two tiles in a transverse course, showing the manner in which the grooves interlock, and further showing the installation of a hurricane clip.

As shown in FIG. 11, two tiles 1 and 1' are engaged by underlock flange 3' and overlock 11. First, tile 1' was installed onto the underlayment, then hurricane clip 23 is mechanically fastened to the roof by well-known means. Hurricane clip 23 has contact with flange 3' at ridge 7' or groove 6' or both.

Figure 12:
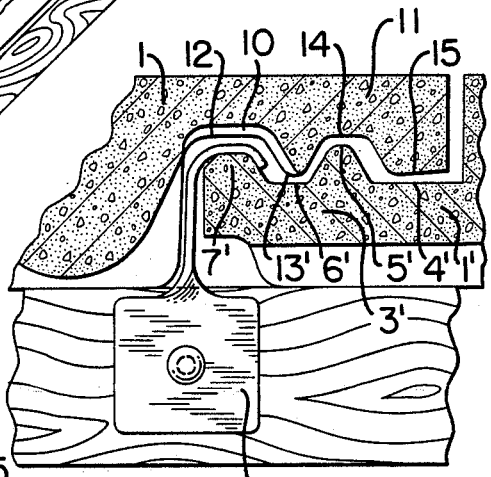
FIG. 12 is a transverse cross-sectional view of a portion of two tiles in a transverse course, showing the manner in which the grooves interlock, and further showing the installation of a second type of hurricane clip.

If tile 1 were not equipped with cutout section 10, tile 1 would come in contact with hurricane clip 23 by at least one of inner groove 12 and inner ridge 13. FIG. 12 shows a hurricane clip 23 of a different style than the clip of FIG. 11, other features of the installation being designated identically to those shown in FIG. 10.

I claim:

1. A flat shingle style concrete roofing tile adapted to be laid over either an underlayment including horizontally disposed battens or an underlayment without battens, in a series of courses on a roof, the tile when laid having a generally planar skywardly facing top surface, a bottom surface facing the underlayment, side edges, and upper and lower edges, a first flange disposed along one side edge of said top surface and extending between said upper and lower edges and a second flange disposed along the opposite side edge of said bottom surface and extending between said upper and lower edges, each said flange forming at least one ridge and at least one groove, the groove of an underlying flange being adapted to receive the ridge of the overlying flange of an adjacent tile, said tile having the same thickness at its upper and lower edges and having an elongated batten support beam molded in said bottom surface at the upper edge thereof extending from near one side edge to near the opposite side edge and protruding a predetermined first distance from the bottom surface for engaging an upper edge of a batten in the event the tile is laid over an underlayment including battens, the downwardly facing surface of said batten support beam being angled in the direction of its width so as to be substantially parallel to and in contact with an underlayment not having battens, and having a cutout formed therein located intermediate its ends for providing a weep hole for allowing runoff of any water that may accumulate between the batten support beam and the underlayment.

2. The roofing tile of claim 1, wherein each of said flanges form two grooves and two ridges, the groove nearest the side edge of the overlying flange being deeper than the other groove of the overlying flange, and the ridge furthest from the side edge of the underlying flange being higher than the ridge nearest the outer edge of the underlying flange.

3. The roofing tile of claim 2, wherein the groove and ridge of the overlying flange furthest from the outer edge has a cutout formed therein near the lower edge of the tile dimensioned to prevent a hurricane clip engaging the underlying flange of an adjacent tile from contacting the tile.

4. The roofing tile of claim 1, wherein said tile has spaced nail holes therethrough located near the lower edge of said batten support beam, and has an elongated cavity molded in the lower portion of the bottom surface of the tile near the lower edge thereof dimensioned to prevent the tile from coming in contact with nails driven through correspondingly located nail holes in the tile of the course below.

* * * * *